US007894749B2

(12) United States Patent
Jung et al.

(10) Patent No.: US 7,894,749 B2
(45) Date of Patent: Feb. 22, 2011

(54) IMAGE FORMING APPARATUS CAPABLE OF RESETTING AND DECREASING A SURFACE POTENTIAL OF A PHOTOSENSITIVE MEMBER

(75) Inventors: Hyun Sun Jung, Seongnam-si (KR); Jin Cheol Kim, Suwon-si (KR); Yoo Seok Yang, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 747 days.

(21) Appl. No.: 11/864,155

(22) Filed: Sep. 28, 2007

(65) Prior Publication Data

US 2008/0159783 A1 Jul. 3, 2008

(30) Foreign Application Priority Data

Jan. 3, 2007 (KR) ..... 10-2007-0000679

(51) Int. Cl.
*G03G 21/00* (2006.01)
*G03G 15/01* (2006.01)

(52) U.S. Cl. ..... 399/128; 399/299

(58) Field of Classification Search ..... 399/128, 399/129, 296, 298, 299
See application file for complete search history.

(56) References Cited

U.S. PATENT DOCUMENTS 4,669,854 A * 6/1987 Ichikawa et al. ..... 399/296
5,983,041 A * 11/1999 Otaki et al. ..... 399/296
6,029,022 A 2/2000 Takase
6,356,726 B1 3/2002 Campbell et al.
7,319,835 B2 * 1/2008 Ahn ..... 399/129
7,580,654 B2 * 8/2009 Okubo ..... 399/128
2004/0005170 A1 1/2004 Ahn

FOREIGN PATENT DOCUMENTS

JP 59-228683 12/1984
JP 2000-56536 2/2000

OTHER PUBLICATIONS

European Search Report issued in European Patent Application No. 07 11 9383 on May 6, 2008.

* cited by examiner

*Primary Examiner*—William J Royer
(74) *Attorney, Agent, or Firm*—Staas & Halsey LLP

(57) ABSTRACT

An image forming apparatus including: a plurality of photosensitive members on which electrostatic latent images are formed; a plurality of charge units to charge the respective photosensitive members with an electric potential; at least one exposure unit which irradiates light to the respective photosensitive members; a plurality of developer supply devices, which adhere a developer to the respective photosensitive members, to form visible images on a surface of the respective photosensitive members; a transfer unit, which transfers the visible images formed on the respective photosensitive members to a transfer medium; and a plurality of exposure lamps which are mounted between the plurality of photosensitive members. Each of the exposure lamps radiates light to the surface of one of two adjacent photosensitive members, after completion of the transfer, to reset a surface potential thereof, and irradiates light to the surface of the other photosensitive member, on which the visible image is formed, to decrease a surface potential thereof.

16 Claims, 4 Drawing Sheets

IMAGE FORMING APPARATUS CAPABLE OF RESETTING AND DECREASING A SURFACE POTENTIAL OF A PHOTOSENSITIVE MEMBER

CROSS-REFERENCE TO RELATED APPLICATION

This application claims the benefit of Korean Application No. 2007-679, filed Jan. 3, 2007, in the Korean Intellectual Property Office, the disclosure of which is incorporated herein by reference.

BACKGROUND

1. Field of the Invention

Aspects of the present invention relate to an image forming apparatus.

2. Description of the Related Art

Generally, an electrophotographic image forming apparatus is configured such that a light beam is radiated onto a photosensitive member charged with an electric potential, to form an electrostatic latent image on the surface of the photosensitive member. The electrostatic latent image is developed into a visible image, by adhering toner to the electrostatic latent image, and the visible image is transferred and fixed onto a printing medium. The electrophotographic image forming apparatus can be classified as a mono-image forming apparatus, if it can print only a black and white image, or as a color image forming apparatus, if it can print a color image.

The black and white image forming apparatus and the color image forming apparatus commonly include: a developing unit having a photosensitive member on which an image is formed; a developer supply device, which adheres a developer (toner) to the photosensitive member; an exposure unit, which radiates a light beam to the photosensitive member according to an image signal, to form an electrostatic latent image; a charge unit, which charges the surface of the photosensitive member with a predetermined electric potential; a transfer unit, which transfers a visible image formed by the developing unit onto a printing medium; and a fixing unit, which applies heat and pressure to the printing medium, onto which the visible image is transferred, to fix the visible image to the surface of the printing medium.

The color image forming apparatus is provided with: four developing units, which respectively form yellow, magenta, cyan, and black images; four exposure units, which radiate a light beam onto the respective developing units; and four charge units, which charge the photosensitive members of the respective developing units.

An image forming process of the color image forming apparatus will now be described. First, the surface of the respective photosensitive members is charged with a predetermined electric potential by the charge units. When the respective exposure units radiate a light beam onto the surface of the charged photosensitive members, electrostatic latent images are formed on the surface of the photosensitive members by an electric potential difference. By adhering developers corresponding to the four colors to the electrostatic latent images, visible images of the four colors are formed. The visible images are transferred to an intermediate transfer belt, or the printing medium, on top of one another, by the transfer unit, and thus a color image is formed.

When the printing is achieved successively, the respective photosensitive members repeatedly undergo the aforesaid charge, exposure, development, and transfer processes. However, because of a residual electric potential on the photosensitive members after the transfer, the surface of the respective photosensitive members may not be charged uniformly. This residual electric potential affects the formation of a successive electrostatic latent image and causes image defects, such as ghost images.

A recently developed method for solving this problem involves resetting the surface potential of the photosensitive members to 0 V, by radiating a light beam onto the respective photosensitive members before the photosensitive members are charged, and then charging the photosensitive members. For this, an eraser lamp is mounted between the transfer unit and the charge unit and is used to irradiate the photosensitive members. The image quality can be improved by the operation of the eraser lamp.

Besides an eraser lamp, a pre-transfer lamp (PTL), mounted between the developer supply device and the transfer unit, can be used to improve the image quality. The pre-transfer lamp radiates light to the surface of the photosensitive members, to which the developer is adhered, before the transfer is achieved, thereby increasing a transfer efficiency. If the pre-transfer lamp irradiates light to the photosensitive member, an electric potential difference between an exposure area and a non-exposure area, on the surface of the photosensitive member, decreases. Accordingly, the developer adhering to the surface of the photosensitive member can be easily transferred onto the intermediate transfer belt or the printing medium, with a low transfer voltage.

However, the installation of the eraser lamp and the pre-transfer lamp in the conventional image forming apparatus causes an increase in the number of components and in the manufacturing costs.

SUMMARY OF THE INVENTION

Therefore, aspects of the invention relate to providing an image forming apparatus that is equipped with a lamp capable of resetting a surface potential and decreasing a surface potential of a photosensitive member, thereby reducing a number of components and manufacturing costs of an image forming apparatus.

Aspects of the present invention relate to an image forming apparatus comprising: a first photosensitive member; a second photosensitive member mounted adjacent to the first photosensitive member; a first transfer area positioned near the first photosensitive member; a second transfer area positioned near the second photosensitive member; and an exposure lamp to radiate light to a portion of the first photosensitive member and to a portion of the second photosensitive member. The portion of the first photosensitive member is rotationally downstream from the first transfer area, with respect to a direction of rotation of the first photosensitive member. The portion of the second photosensitive member is rotationally upstream from the second transfer area, with respect to a rotational direction of the second photosensitive member.

According to an aspect of the invention, the image forming apparatus may further comprise semi-transparent film, disposed between the exposure lamp and the second photosensitive member, to decrease an intensity of light radiated therebetween.

According to an aspect of the invention, the semi-transparent film may have a curved surface to concentrate light onto a point on the surface of the second photosensitive member.

According to an aspect of the invention, the image forming apparatus may further comprise: developing units, each developing unit including one of the photosensitive members, a developer supply device to adhere a developer to the photosensitive member, and a charge unit to charge the photosensitive member with an electric potential. The developing units are arranged in parallel, in an order in which the visible images are transferred to a transfer medium. The developing units comprise a first developing unit and a last developing unit, which are respectively disposed at a first position and a last position in the order in which visible images are transferred. The last developing unit further comprises a semi-transparent film, and the first developing unit comprises an exposure lamp.

According to an aspect of the invention, the last developing unit further comprises an eraser lamp to radiate light to the surface of the photosensitive member of the last developing unit, to reset a surface potential thereof.

According to an aspect of the invention, the semi-transparent film has an optical property which decreases an intensity of the light from the exposure lamp, so as to decrease the surface potential of the second photosensitive member to an absolute value of about 150V to 250 V.

According to an aspect of the invention, the image forming apparatus may further comprise: a plurality of charge units to charge the respective photosensitive members with a predetermined electric potential; a plurality of developer supply devices to adhere developer to each of the photosensitive members and thereby form visible images on a surface of the photosensitive members. The charge units, the photosensitive members, and the developer supply devices are assembled into developing units including the exposure lamps.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and/or advantages of the invention will become apparent and more readily appreciated, from the following description of the embodiments, taken in conjunction with the accompanying drawings, of which.

DETAILED DESCRIPTION OF THE EMBODIMENTS

Figure 1:
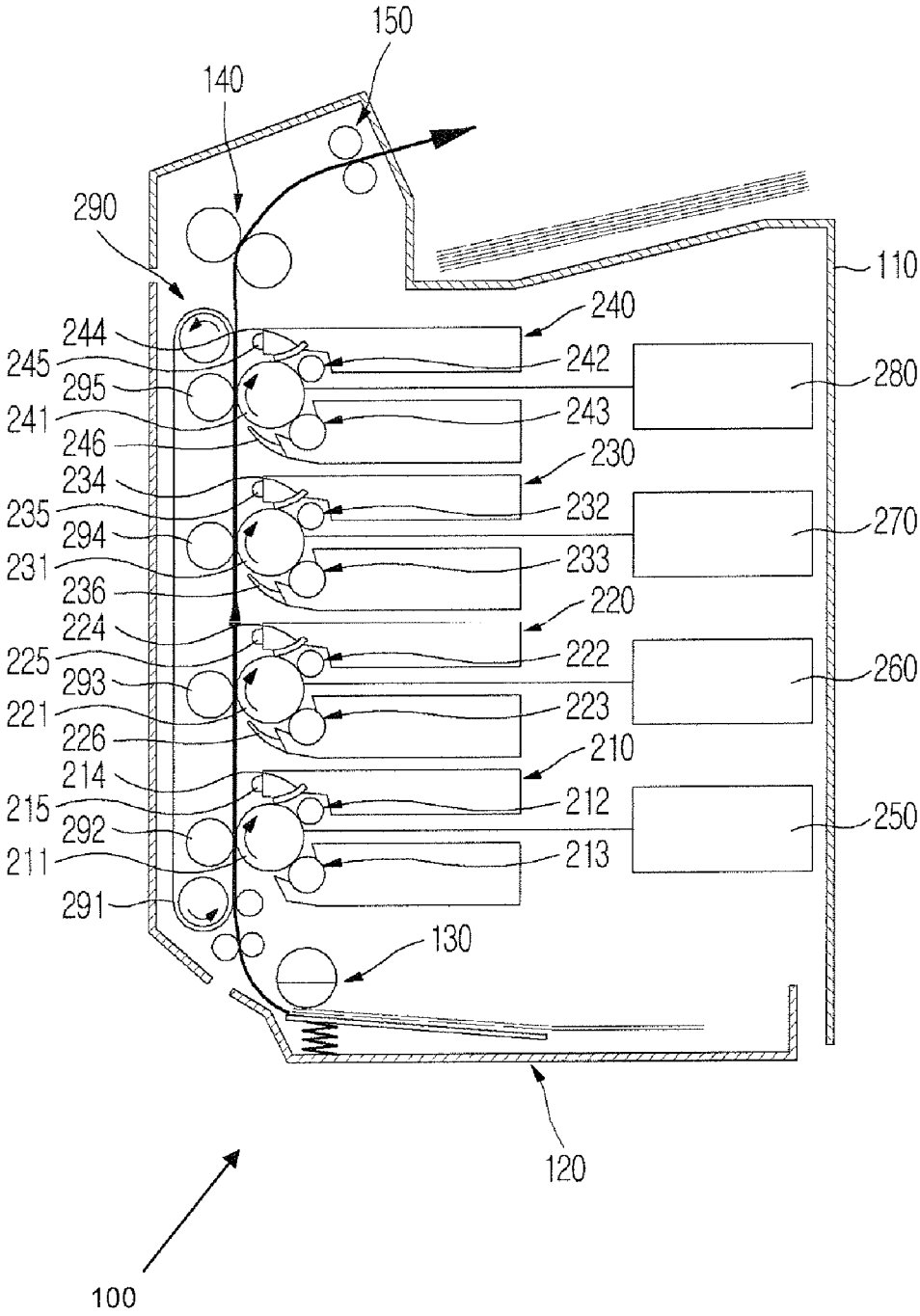
FIG. 1 is a side-sectional view illustrating schematically an image forming apparatus, according to aspects of the present invention.

Reference will now be made in detail to exemplary embodiments of the present invention, examples of which are illustrated in the accompanying drawings, wherein like reference numerals refer to like elements throughout. The embodiments are described below to explain the present invention, by referring to the figures.

As shown in FIG. 1, an image forming apparatus 100, according to aspects of the present invention, includes: a main body 110 to house various components and form an external appearance; a plurality of developing units 210, 220, 230, and 240 to form visible images of different colors; a plurality of exposure units 250, 260, 270, and 280 mounted to the respective developing units 210, 220, 230, and 240, to irradiate a corresponding light beam onto the corresponding developing units 210, 220, 230, and 240, according to an image signal; and a transfer unit 290 to transfer the visible images from the respective developing units 210, 220, 230, and 240 onto a printing medium (not shown). Instead of the plurality of exposure units 250, 260, 270, and 280, a single exposure unit that is capable of irradiating the respective developing units 210, 220, 230, and 240, may be used, such as by dividing the separated light and radiating the divided light onto the respective developing units 210, 220, 230, and 240. The main body 110 accommodates a printing medium supply unit 120 to supply the printing medium; a pickup device 130 to pick up the printing medium from the printing medium supply unit 120 a sheet at a time; a fixing unit 140 to apply heat and pressure to the printing medium, onto which the visible images are transferred, to form a color image, to fix the color image to the printing medium; and a printing medium discharge unit 150 to discharge printing medium having the color images. While not required, other numbers of developing units can be used.

Figure 2:
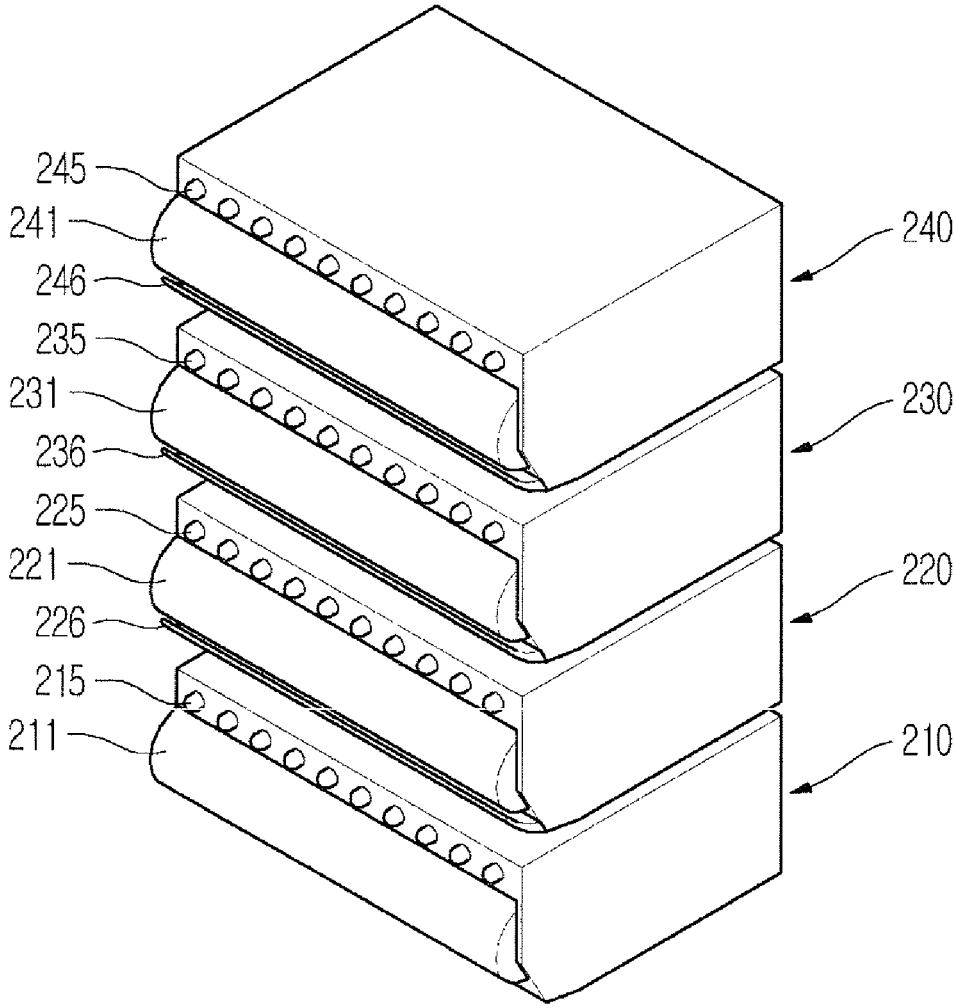
FIG. 2 is a perspective view illustrating developing units of an image forming apparatus, according to aspects of the present invention.

The first to fourth developing units 210, 220, 230, and 240 form visible images of four different colors (e.g., yellow, magenta, cyan, and black). The developing units 210, 220, 230, and 240 respectively include: photosensitive members 211, 221, 231, and 241, on which the electrostatic latent images are formed, charge units 212, 222, 232, and 242, which charge the surface of the photosensitive members 211, 221, 231, and 241 with a predetermined electric potential; developer supply devices 213, 223, 233, and 243, which adhere the developer to the surface of the photosensitive members 211, 221, 231, and 241, on which the electrostatic latent images are formed, to form the visible images; cleaning blades 214, 224, 234, and 244, which remove the residual developer from the surface of the photosensitive members 211, 221, 231, and 241 after the transfer; and exposure lamps 215, 225, 235, and 245, which irradiate the surface of the photosensitive members 211, 221, 231, and 241 after the transfer, to reset a surface potential to 0 V. As shown in FIGS. 1 and 2, the developing units 210, 220, 230, and 240 are arranged in parallel with each other with a regular gap in a vertical direction, along the transfer unit 290. Since the first to fourth developing units 210, 220, 230, and 240 have substantially similar constitutions, the constitution and operation of only the first developing unit 210 will be representatively described hereinafter. While described in terms of specific colors, it is understood that other color combinations can be used instead of, or in addition to, the exemplary colors. Further, any number of developing units can be used.

When the printing operation is performed, the charge unit 212 charges the surface of the rotating photosensitive member 211 with a predetermined electric potential (e.g., −750 V). The exposure unit 250 irradiates the surface of the photosensitive member 211 charged by the charge unit 212 (exposure area), the electric potential of the exposure area decreases to a value (e.g., −50 V), and the electrostatic latent image is formed. The developer supply device 213 adheres the developer to the electrostatic latent image on surface of the photosensitive member 211, and a visible image of a single color (yellow) is thereby formed on the surface of the photosensitive member 211. The visible image (yellow) on the surface of the photosensitive member 211 is transferred onto the printing medium by the transfer unit 290. Similar processes occur for the remaining developing units 220, 230, and 240.

As shown in FIG. 1, the transfer unit 290 includes a printing medium feed belt 291. The feed belt 291 travels in one direction to feed the printing medium past the developing units 210, 220, 230, and 240. Transfer rollers 292, 293, 294, and 295, which are mounted corresponding to the respective photosensitive members 211, 221, 231, and 241, transfer the visible images formed on the surface of the respective photosensitive members 211, 221, 231 and 241, as the print medium is transferred. A constant transfer voltage (e.g., +470 V) is applied to the transfer rollers 292, 293, 294, and 295 so as to attract the visible images formed on the surface of the respective photosensitive members 211, 221, 231, and 241 to the printing medium. Because the visible images, formed on the surface of the respective photosensitive members 211, 221, 231, and 241 are directly transferred, the printing medium is a transfer medium. However, in another aspect, if an intermediate transfer belt is also used instead of or in addition to the printing medium transfer belt 291, the transfer medium is the intermediate feed belt. In other words, the visible images on the respective photosensitive members 211, 221, 231, and 241 are transferred onto the intermediate transfer belt, and then transferred onto the printing medium.

When the transfer is completed, the surface of the photosensitive member 211 is exposed to the light radiated from the exposure lamp 215. The exposure lamp 215 irradiates the photosensitive member 211, between an area where the transfer is achieved (transfer area) and the exposure area where the charge is achieved, so as to reset the surface potential of the photosensitive member 211, after the completion of the transfer, to 0 V. After the surface potential of the photosensitive member 211 is reset to 0 V, the photosensitive member 211 is charged. Accordingly, the surface of the photosensitive member 211 can be uniformly charged. The exposure lamp 215 can increase a transfer efficiency of the second developing unit 220. The exposure lamp 215 can reset the surface potential of the photosensitive member 211. The operation of the exposure lamp 215 will be described below, in detail. Like operations can be performed by the exposure lamps 225, 235, and 245.

The cleaning blade 214 is mounted in contact with the surface of the photosensitive member 211, between the transfer area and the exposure area of the photosensitive member 211. The cleaning blade 214 removes the residual developer from the surface of the photosensitive member 211, after the completion of the transfer, to clean the surface of the photosensitive member 211. Like operations can be performed by the cleaning blades 224, 234, and 244.

The process, by which the first developing unit 210 forms the visible image of the single color and the visible image is transferred, is used by the second to fourth developing units 220, 230, and 240, at a regular interval. In other words, the visible image (yellow), formed by the first developing unit 210, is first transferred onto the printing medium, and then the visible image (magenta), formed by the second developing unit 220, is transferred onto the printing medium. Subsequently, the visible image (cyan), formed by the third developing unit 230, is transferred onto the printing medium, and then the visible image (black), formed by the fourth developing unit 240, is transferred onto the printing medium. The visible images are overlapped on the printing medium. Accordingly, a color image comprising the visible images is formed on the surface of the printing medium, as the printing medium passes through the fourth developing unit 240.

When a color image is printed, by the operation of the developing units 210, 220, 230, and 240, the light generated by the first exposure lamp 215 has an influence on the first photosensitive member 211, of the first developing unit 210, and the second photosensitive member 221, of the second developing unit 220. The second developing unit 220 is mounted adjacent to the first exposure lamp 215. In other words, the light generated from the first exposure lamp 215 is radiated onto the surface of the first photosensitive member 211, after the completion of the transfer, so as to reset the surface potential of the first photosensitive member 211. At the same time, the light from the first exposure lamp 215 is radiated onto the surface of the second photosensitive member 221, on which the visible image (magenta) is formed, so as to decrease the surface potential of the area of the second photosensitive member 221 where the visible image (magenta) is not formed.

If the light irradiated on the second photosensitive member 221 from the first exposure lamp 215 is too intense, the visible image (magenta) on the second photosensitive member 221 can be easily transferred with a low transfer voltage. However, the quality of the image may be reduced during the transfer. If an insufficient amount of light is irradiated on the surface of the second photosensitive member 221, the exposure lamp 215 may not increase the transfer efficiency. In order to properly irradiate the surface of the second photosensitive member 221, a first semi-transparent film 226 is mounted between the first exposure lamp 215 and the second photosensitive member 221. The first semi-transparent film 226 can decrease the intensity of the light from first exposure lamp 215. However, it is understood that other mechanisms can be used to regulate an intensity of the light radiated from the first exposure lamp 215 to the second photosensitive member 221 instead of or in addition to the first semi-transparent film 226. For instance, intensity can be adjusted by changing a spacing between the first exposure lamp 215 and the photosensitive member 221, by coating a side of the first exposure lamp 215, and the like.

As shown in FIGS. 1 and 2, the first semi-transparent film 226 is mounted below the second developing unit 220. The first semi-transparent film 226 has a surface which is curved upward (i.e., is concave towards the second developing unit 220). The curved surface can concentrate light to a point, similar to a lens. The light passing through the first semi-transparent film 226 is focused to a point on the second photosensitive member 221, and decreases the surface potential of the second photosensitive member 221. Experiments show that when the surface potential of the photosensitive member decreases to about −150 to −250 V, a degradation of image quality does not occur, and transfer efficiency is improved. Accordingly, the transmissivity of the first semi-transparent film 226 can be determined so as to satisfy the condition that the light from the first exposure lamp 215 resets the surface potential of the first photosensitive member 211 to 0 V and decreases the surface potential of the second photosensitive member 221 to −150 to −250 V. However, it is understood that other surface potentials can be used, and that the semi-transparent film 226 can be adapted accordingly.

Figure 3:
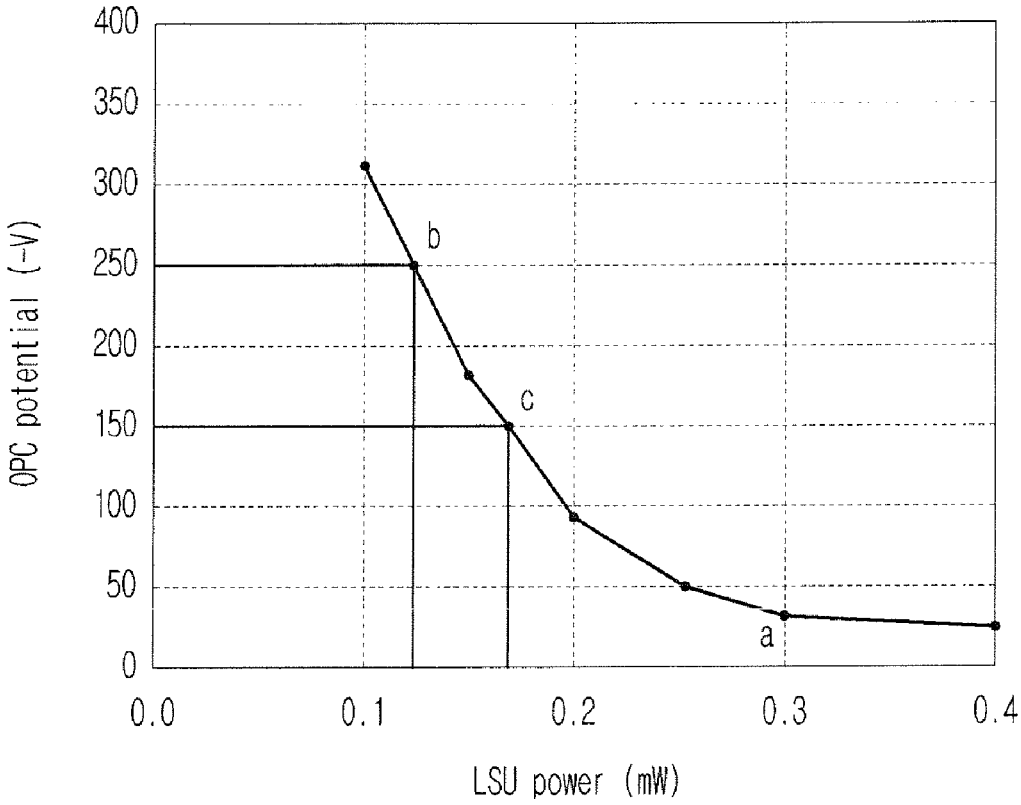
FIG. 3 is a graph illustrating a relationship between an intensity of light radiated from a exposure unit and a surface potential of a photosensitive member exposed to light in the image forming apparatus, according to aspects of the present invention.

FIG. 3 is a graph illustrating a relationship between the power applied (mW) to an exposure unit (light intensity) and the surface potential of a photosensitive member exposed to the light in the image forming apparatus 100, according to aspects of the present invention. As shown in the graph, when the power applied is larger than a value of the point a, the surface potential of the exposed photosensitive member is approximately 0 V. Thus, if the power applied to the first exposure lamp 215 is set to a value corresponding to the point a, or larger, and the first exposure lamp 215 irradiates the first photosensitive member 211, the surface potential of the first photosensitive member 211 can be reset to 0 V.

The graph also shows that an applied power, capable of adjusting the surface potential of the second photosensitive member 221 to −150 to −250 V, is in the range between a point b and a point c. If the transmissivity of the first semi-transparent film 226 is set to a value of between about c/a to b/a, the surface potential of the second photosensitive member 221 can be decreased to about −150 to −250 V, by the light passing through the first semi-transparent film 226.

In the same manner, a second semi-transparent film 236 mounted between the second exposure lamp 225 and the third photosensitive member 231, and a third semi-transparent film 246 mounted between the third exposure lamp 235 and the fourth photosensitive member 241, can be designed to have the same transmissivity as the first semi-transparent film 226. The semi-transparent film 226 may be made of glass, plastic, or another semi-transparent material having suitable characteristics. Further, while described as being the same, it is understood that the semi-transparent films can be different materials, and/or differently shaped.

As shown in FIGS. 1 and 2, a semi-transparent film need not be provided for the first developing unit 210. No light is irradiated onto the surface of the first photosensitive member 211, to decrease the surface potential thereof. A decrease in the transfer efficiency of a visible image is generally caused when another visible image is transferred onto a portion of a printing medium where at least one visible image has been already transferred. Accordingly, without decreasing the surface potential of the first photosensitive member 211, in which the transfer is achieved for the first time, the visible image (yellow) can be smoothly transferred. However, it is understood that the surface potential of the first photosensitive member 211 could be reduced in other aspects of the invention. Further, it is understood that the semi-transparent films need not be used in all aspects.

Figure 4:
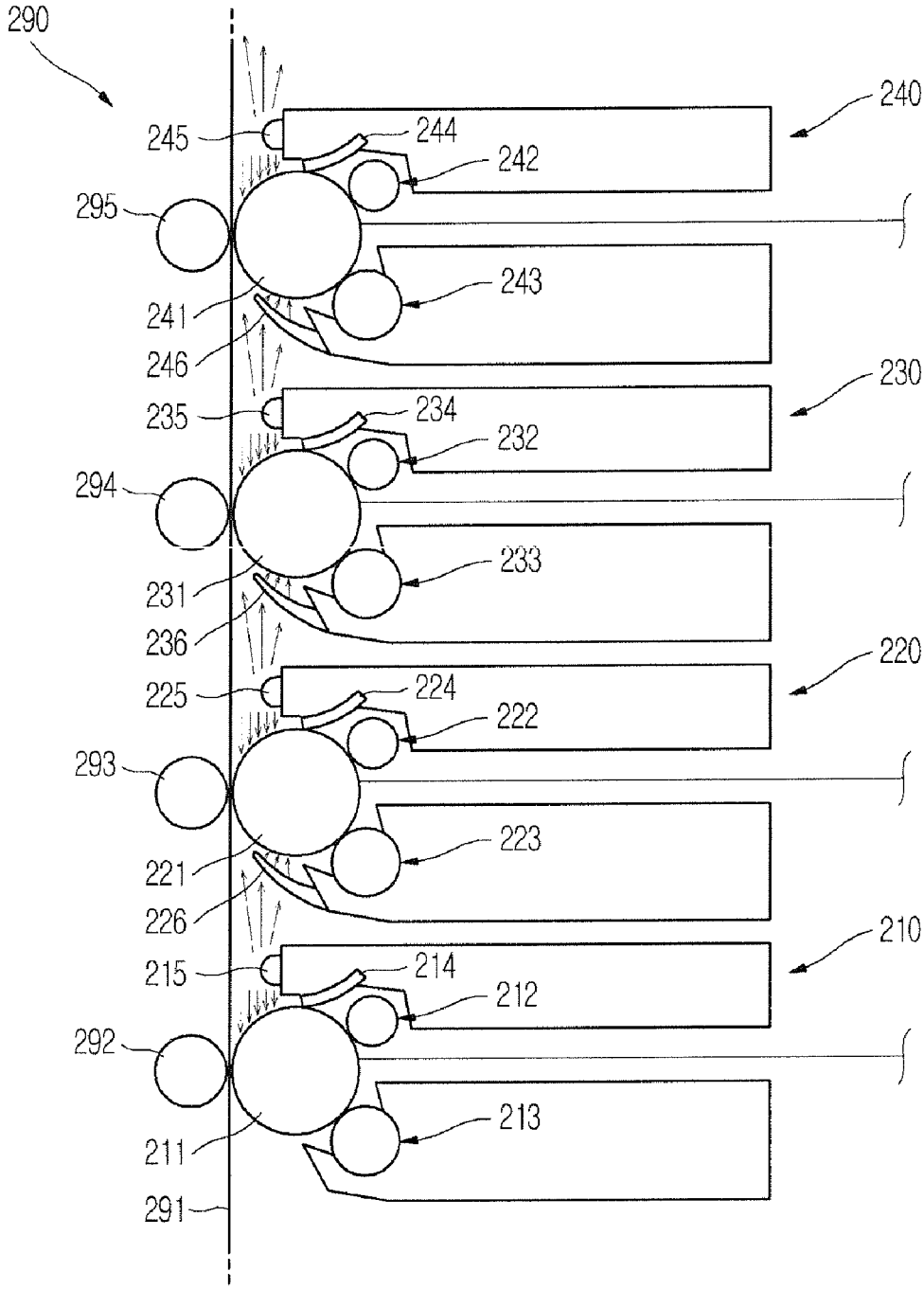
FIG. 4 is a side-sectional view illustrating components in an image forming apparatus, according to aspects of the present invention.

As shown in FIG. 4, the light from the first to fourth exposure lamps 215, 225, 235, and 245, mounted above the first to fourth photosensitive members 211, 221, 231, and 241, is directly radiated onto the surface of the respective photosensitive members 211, 221, 231, and 241, and resets the surface potential of the respective photosensitive members 211 221, 231, and 241 to 0 V. At the same time, the light from the first to third exposure lamps 215, 225, and 235 respectively passes through the first to third semi-transparent films 226, 236, and 246 and is irradiated onto the surface of the second to fourth photosensitive members 221, 231, and 241. The surface potential of the respective photosensitive members 221, 231, and 241, on which the visible images are formed, is decreased, thereby achieving a smooth image transfer. As described above, each of the first to third exposure lamps 215, 225, and 235 act as eraser lamps and pre-transfer lamps. The fourth exposure lamp 245 acts only as an eraser lamp.

As is apparent from the above description, an image forming apparatus, according to aspects of the present invention, is equipped with the exposure lamps that are mounted between the photosensitive members and irradiate light to the adjacent photosensitive members, so as to reset the surface potential of the photosensitive members to 0 V. Thereby a smooth charge is achieved, and the surface potential of the photosensitive members, on which the visible images are formed, is decreased. This increases the transfer efficiency of the photosensitive members. Since each of the exposure lamps can be both an eraser lamp and a pre-transfer lamp, the number of components and manufacturing costs can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a first photosensitive member;

a second photosensitive member mounted adjacent to the first photosensitive member;

a first transfer area disposed adjacent to the first photosensitive member;

a second transfer area disposed adjacent to the second photosensitive member; and an exposure lamp to radiate light to a portion of the first photosensitive member and to a portion of the second photosensitive member;

wherein the portion of the first photosensitive member is rotationally downstream of the first transfer area, with respect to a rotational direction of the first photosensitive member, and the portion of the second photosensitive member is rotationally upstream of the second transfer area, with respect to a rotational direction of the second photosensitive member.

2. The image forming apparatus according to claim 1, further comprising:

semi-transparent film, disposed between the exposure lamp and the second photosensitive member, to decrease an intensity of light radiated therebetween.

3. The image forming apparatus according to claim 2, wherein the semi-transparent film has a curved surface to concentrate the light to a point on the surface of the second photosensitive member.

4. The image forming apparatus according to claim 2, further comprising:

developing units, each developing unit including one of the photosensitive members, a developer supply device to adhere a developer to the photosensitive member, and a charge unit to charge the photosensitive member with an electric potential, wherein, the developing units are arranged in parallel, in an order in which visible images are transferred to a transfer medium, the developing units comprise a first developing unit and a last developing unit, which are respectively disposed at a first position and a last position in that order, the last developing unit further comprises the semi-transparent film, and the first developing unit comprises the exposure lamp.

5. The image forming apparatus according to claim 4, wherein the last developing unit further comprises an eraser lamp to radiate light to the surface of the photosensitive member of the last developing unit, to reset a surface potential thereof.

6. The image forming apparatus according to claim 2, wherein the semi-transparent film has an optical property which decreases the light from the exposure lamp so as to decrease a surface potential of the second photosensitive member to an absolute value of about 150V to 250 V.

7. The image forming apparatus according to claim 1, further comprising:

a plurality of charge units to charge the first and second photosensitive members with an electric potential;

a plurality of developer supply devices to adhere developer to the respective photosensitive members to form visible images on a surface of the first and second photosensitive members;

wherein the plurality of charge units, the first and second photosensitive members, and the plurality of developer supply devices are assembled to constitute developing units, and the exposure lamp is provided in one of the developing units.

8. The image forming apparatus according to claim 1, wherein the exposure lamp is partially coated to reduce an intensity of the light radiated to the second photosensitive member from the exposure lamp.

9. An image forming apparatus comprising:

a first photosensitive member;

a second photosensitive member disposed adjacent to the first photosensitive member;

an exposure lamp disposed between the first and second photosensitive members, to radiate light to the first and second photosensitive members and which resets a surface potential of the first photosensitive member; and a semi-transparent film disposed between the exposure lamp and the second photosensitive member such that the radiated light from the exposure lamp, after passing through the semi-transparent film, decreases a surface potential of the second photosensitive member.

10. The image forming apparatus of claim 9, wherein the semi-transparent film decreases the intensity of the light radiated there through.

11. The image forming apparatus of claim 9, wherein the semi-transparent film is curved and focuses the light radiated there through onto the second photosensitive member.

12. The image forming apparatus of claim 9, wherein the semi-transparent film decreases an intensity of the light radiated there through, to reduce the surface potential of the second photo sensitive member to an absolute value of about 150V to 250 V.

13. The image forming apparatus of claim 9, further comprising an exposure unit to form electrostatic latent images on the first and second photosensitive members; and a transfer unit to transfer visible images from the first and second photosensitive members to a transfer medium.

14. The image forming apparatus of claim 9, further comprising an eraser lamp disposed adjacent to the second photosensitive member, to reset a surface potential thereof.

15. A developing unit of an image forming apparatus, comprising:

a photosensitive member to form visible images;

a charge unit to form a surface potential on the photosensitive member;

a developer supply device to supply developer used to form the visible images, to the photosensitive member;

a semi-transparent film disposed adjacent to a first side of the photosensitive member, to filter light radiated toward the photosensitive member from an exposure lamp of an adjacent developing unit, to decrease a surface potential of the photosensitive member; and at least one exposure lamp disposed to radiate light to a second side of the photosensitive member to reset a surface potential thereof and to radiate light to a photosensitive member of an adjacent developing unit, to decrease a surface potential thereof.

16. The developing unit of claim 15, wherein the semi-transparent film is curved to focus the light radiated there through.

* * * * *

UNITED STATES PATENT AND TRADEMARK OFFICE

CERTIFICATE OF CORRECTION

PATENT NO. : 7,894,749 B2
APPLICATION NO. : 11/864155
DATED : February 22, 2011
INVENTOR(S) : Hyun Sun Jung et al.

It is certified that error appears in the above-identified patent and that said Letters Patent is hereby corrected as shown below:

Column 10, Line 2 in Claim 12, delete “photo sensitive” and insert -- photosensitive --, therefor.

Signed and Sealed this
Thirty-first Day of May, 2011

David J. Kappos

David J. Kappos
*Director of the United States Patent and Trademark Office*